US005250773A

United States Patent [19]

Lind et al.

[11] Patent Number: 5,250,773

[45] Date of Patent: Oct. 5, 1993

[54] MICROWAVE HEATING DEVICE

[75] Inventors: Arthur C. Lind, Chesterfield; Frederick C. Wear, St. Louis, both of Mo.

[73] Assignee: McDonnell Douglas Corporation, St. Louis, Mo.

[21] Appl. No.: 667,657

[22] Filed: Mar. 11, 1991

[51] Int. Cl.[5] ..... H05B 6/64

[52] U.S. Cl. ..... 219/10.55 A; 219/10.55 F

[58] Field of Search ..... 219/10.55 A, 10.55 R, 219/10.55 F

[56] References Cited

U.S. PATENT DOCUMENTS

| | | | |
|---|---|---|---|
| 2,497,670 | 2/1950 | Hanson et al. | 219/10.55 A |
| 3,557,334 | 1/1971 | Lewis | 219/10.55 A |
| 4,060,443 | 11/1977 | Balla | 219/10.55 A |
| 4,144,434 | 3/1979 | Chiron et al. | 219/10.55 F |
| 4,392,039 | 7/1983 | Risman | 219/10.55 A |
| 4,517,026 | 5/1985 | Inoue | 219/10.55 A |
| 4,780,585 | 10/1988 | Rochas et al. | 219/10.55 A |
| 4,883,570 | 11/1989 | Ethimion et al. | 219/10.55 A |

*Primary Examiner*—Philip H. Leung

*Attorney, Agent, or Firm*—Guy R. Gosnell; Benjamin Hudson, Jr.; Timothy H. Courson

[57] ABSTRACT

There is provided by this invention an open-ended cavity microwave applicator apparatus for inducing current into an electrically conductive workpiece to be heated without need for the the applicator to be in contact with the workpiece. The microwave applicator is comprised of an open-ended housing that defines a cylindrical cavity which is coupled by an aperture to a waveguide which transmits the microwave energy from a microwave generator to the cylindrical applicator cavity. The microwave applicator is designed to operate in a subset of the circular $TE_{mnp}$ modes where m, n and p are the number of half wavelength variations in the standing wave pattern in the $\theta$, r,and z directions, respectively. The particular subset desired is the one in which m is equal to zero such that no current flows from the applicator to the electrically conductive workpiece. Of the subset of axially symmetric modes, $TE_{0np}$, the preferred mode of operation is circular $TE_{011}$. A conductive back plate forms one end of the applicator cavity while the other end is open so as to allow the microwave radiation to induce closed-loop currents in the workpiece being heated. The conductive back plate may be adjustable so as to vary the axial cavity length to accomodate variations in generator operating frequency and in the distance between the applicator and the workpiece. Furthermore, the applicator cavity may be filled or partially filled with one or more dielectric materials, either isotropic or anisotropic, to alter the physical size and shape of the cavity while supporting the same frequency of $TE_{mnp}$ circular mode microwave radiation.

15 Claims, 2 Drawing Sheets

FIG. 3.
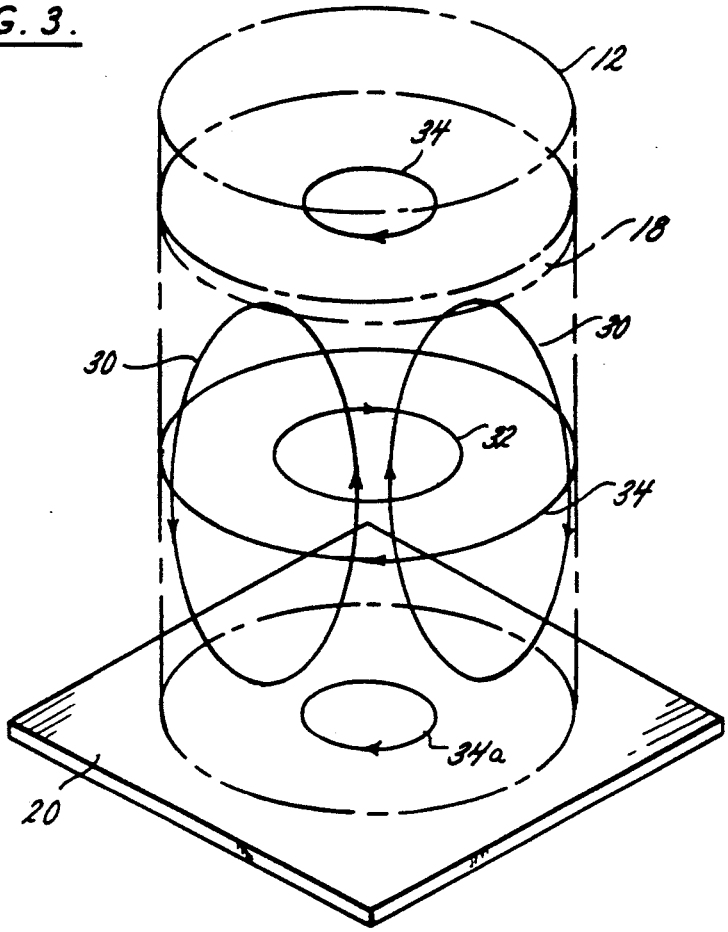
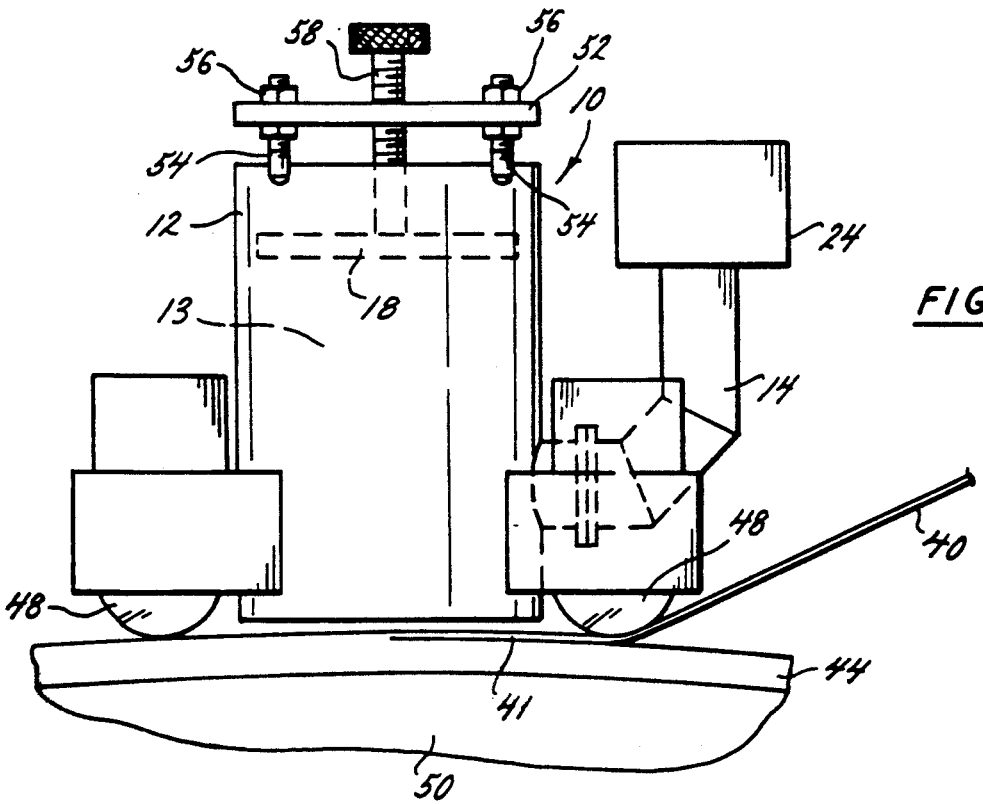
FIG. 4.

MICROWAVE HEATING DEVICE

BACKGROUND OF THE INVENTION

1. Field of the Invention

The present invention relates generally to microwave applicators for heating an electrically-conductive workpiece and more particularly to microwave applicators for heating an electrically-conductive workpiece wherein the applicator and the workpiece need not be in contact and the workpiece may be external to the microwave applicator.

2. Description of the Prior Art

In many modern applications, composite materials are utilized to produce structures which are lightweight, but have the same strength as similar structures composed of metals or other alternative materials. A composite material usually consists of high-strength fibers embedded in a resin matrix that binds the fibers together into the form required for the structural function. Frequently, the most useful fibers are made of carbon, a good electrical conductor.

The use of such composite materials has been generally restricted to relatively small structures due to the requirements of the composite materials manufacturing process which typically utilizes an autoclave or press in which the composite structure must fit in order to bind the individual sheets or ribbons of composite material together to form the finished part. Thus, the size of composite parts has generally been limited by the size of the autoclaves and presses available.

Microwave heating has been employed as an alternative heat source in forming composite parts since it can be instantaneously turned on or off as well as varied in amount as required by the process. However, most attempts have utilized a microwave oven type device, typically referred to as a multimode cavity, which suffered from several deficiencies. Once again, the size of the microwave oven cavity limited the size of the composite parts capable of being processed since the parts were required to be placed inside the oven. Additionally, composite parts which utilized conductive fibers reflected the microwaves so that the conductive material was heated little if at all. Composite parts formed from conductive materials also caused significant arcing and sparking when heated with microwave radiation.

An alternative method of microwave heating is accomplished by having an open-ended microwave applicator which is externally passed over the surface of the object to be heated so as to heat the workpiece with the microwave energy radiating from a cavity of the applicator. A typical microwave applicator which has an open cavity is shown in U.S. Pat. No. 4,392,039 (hereinafter the '039 patent), Dielectric Heating Applicator, issued to Per O. Risman on Jul. 5, 1983. The '039 patent is generally only applicable to the heating of surfaces which are not electrically conductive. This limited application is due to the heating in the '039 patent being accomplished by dielectric losses in the irradiated material with the amount of heating dependent on the penetration depth of the energy into the material. Thus, the use of dielectric heating for conductive materials, such as carbon fiber composite materials, would be ineffective due to the large electrical conductivity of the conductive material which would only allow insubstantial penetration by the microwave energy and would reflect the energy back toward the microwave source so that the conductive material would be heated very little.

Furthermore, a common problem of open cavity microwave applicators in heating electrically conductive workpieces is the necessity to maintain electrical contact between the applicator and the object to be heated to allow electrical currents to flow between the cavity walls of the applicator and the object. If contact is not maintained, damaging arcing over the gap could occur as well as substantial lowering of the energy transfer efficiency and variance of the energy flow so as to cause uneven heating. Additionally, controlling the position of the microwave applicator so as to maintain electrical contact with the object to be heated without applying excessive pressure to the workpiece so that the applicator does not scrub the surface of the workpiece and impart undesirable finish marks is difficult and becomes increasingly more so as the speed with which the applicator moves over the object's surface increases.

It would be desirable to develop an open-ended cavity microwave applicator for heating electrically conductive materials which did not require electrical currents to pass from the applicator to the material being formed so that the applicator does not need to be in constant contact with the object to be heated in order to avoid undesirable finish marks, while not suffering from arcing, decreased energy transfer efficiency, and varied energy flow. Furthermore, it would be desirable to develop and open-ended cavity microwave applicator which did not limit the dimensions of the workpiece on which the applicator was capable of heating.

SUMMARY OF THE INVENTION

There is provided by this invention an open-ended cavity microwave applicator apparatus for inducing current into an electrically conductive workpiece to be heated without need for the applicator to be in contact with the workpiece. The microwave applicator is comprised of an open-ended housing that defines a cylindrical cavity which is coupled by an aperture to a waveguide which transmits the microwave energy from a microwave generator to the cylindrical applicator cavity. The microwave applicator is designed to operate in a subset of the circular $TE_{mnp}$ modes where m, n and p are the number of half wavelength variations in the standing wave pattern in the $\theta$, r, and z directions, respectively. The particular subset desired is the one in which m is equal to zero such that no current flows from the applicator to the electrically conductive workpiece. Of the subset of axially symmetric modes, $TE_{0np}$, the preferred mode of operation is circular $TE_{011}$. A conductive back plate forms one end of the applicator cavity while the other end is open so as to allow the microwave radiation to induce closed-loop currents in the workpiece being heated. The conductive back plate may be adjustable so as to vary the axial cavity length so that variations in generator operating frequency and in the distance between the applicator and the workpiece may be accommodated. Furthermore, the applicator cavity may be filled or partially filled with one or more dielectric materials, either isotropic or anisotropic, to alter the physical size and shape of the cavity while supporting the same frequency of $TE_{mnp}$ circular mode microwave radiation. By utilizing the preferred $TE_{011}$ circular mode, current may be induced to flow in an electrically conductive material to heat the material without requiring current to flow between the applicator and the heated material, thus obviating tool marks and arcs present in prior art applicators. Additionally, the current may be induced in the workpiece without need for contact between the applicator and the workpiece or need for the workpiece to be heated to be placed inside the applicator cavity so as to further avoid the deficiencies of prior art applicators.

BRIEF DESCRIPTION OF THE DRAWINGS

FIG. 3 is an illustration of the magnetic field, electric field, and current within the microwave applicator and the surface to be heated; and FIG. 4 is a side view of an application utilizing the microwave applicator to bond a conductive-fiber tape to a preformed substrate material.

DETAILED DESCRIPTION OF THE PREFERRED EMBODIMENT

Figure 1:
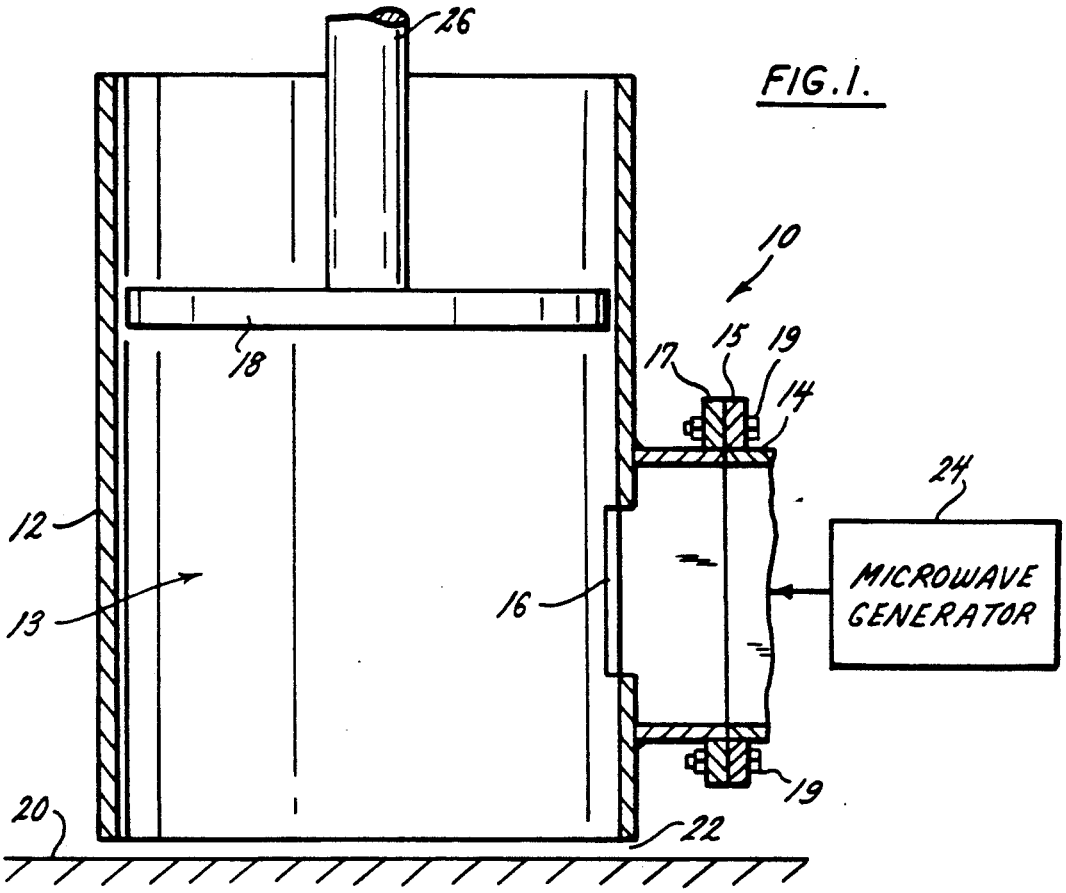
FIG. 1 is a side sectional view of a microwave applicator incorporating the principles of this invention.

Referring to FIG. 1, there is shown a side sectional view of a microwave applicator 10 incorporating the principles of this invention. The microwave applicator 10 is generally comprised of a metal housing 12, preferably cylindrical, defining an applicator cavity 13, which is connected by a coupling aperture 16 to a waveguide 14 which transmits the microwave energy from a microwave generator 24 to the applicator cavity 13. The metal housing 12 is constructed from a conductive metal material, such as aluminum or copper. As well known to those skilled in the art, the microwave generator 24 may be a Cober S6-F or Gerling Laboratory GL122 for 2450 megahertz operation, or a Cober L-50 or Microdry IV-60 for 915 megahertz operation, or any other known microwave generator.

A conductive back plate 18 forms one end of the applicator cavity 13, while the workpiece surface 20 to be heated forms the other end of the applicator cavity 13. The workpiece 20 is not required to be within the microwave cavity as necessitated by some prior art systems and may be separated from the microwave applicator 10 by a gap 22 of 0.001 inches to 0.5 inches or more as hereinafter described.

The waveguide 14 delivers the microwave energy to the applicator cavity 13 from a standard microwave generator 24. The design of the waveguide 14 may be met by any of the typical waveguide designs, such as one that is rectangular in cross-section as illustrated in FIG. 1, which couple microwave energy from a source to a destination which are well known to those skilled in the art. Examples of typical waveguide structures are shown on pages 97–120 in Electron Spin Resonance by Charles P. Poole, Jr., 1st Ed. 1967, published by Interscience Publishers a division of John Wiley & Sons. The waveguide 14 may be attached to the housing 12 in any manner known by those skilled in the art which forms a tight seal, including the fastening of a flanged end 15 of the waveguide 14 to a flanged opening 17 of the housing 12 by means of a fastener 19.

The coupling aperture 16 is required to form an impedance transformer between the waveguide 14 and the applicator cavity 13. The aperture 16 must match the impedance of the applicator cavity 13 with that of the waveguide 14 delivering the microwave energy to the cavity 13. The coupling aperture 16, the design of which is well known to those skilled in the art, may be as simple as a rectangular hole, as shown in FIG. 1, or may be implemented as a more elaborate tuneable structure if desired. Illustrations of typical aperture designs are shown on pages 242–244 of Electron Spin Resonance by Charles P. Poole, Jr.

The microwave applicator 10 is designed to support the circular $TE_{mnp}$ modes, where m is always zero, and n and p are positive integers greater than zero, which are naturally occurring resonances that appear spontaneously in a circular cavity such as the cylindrical applicator cavity 13 defined by the housing 12. The cylindrical housing 12 is constructed of a conductive material as described above with a diameter selected in relation to the distance between the back plate 18 and workpiece surface 20 in a manner hereinafter described so as to support a specific microwave radiation frequency of the circular $TE_{0np}$ mode within the cavity 13. While the $TE_{011}$ mode is the preferred mode other modes may be used, such as $TE_{012}$, $TE_{021}$, or any $TE_{0np}$ mode wherein n and p are positive integers greater than zero. $TE_{0np}$ modes are preferred over other naturally occurring modes, such as $TE_{mnp}$, wherein subscript m is a positive whole number greater than zero, or $TM_{mnp}$. The other competing modes require currents to flow between the applicator 10 and the workpiece 20. This current is required to flow between the applicator 10 and the workpiece 20 due to the modes' inducing longitudinal currents in the walls of the housing 12.

In order to select the preferred $TE_{0np}$ modes, the other naturally occurring modes are suppressed by creating conditions which inhibit the non-preferred modes. One method of suppressing the non-preferred modes is to insure that there is no electrical contact between the housing 12 and an endplate, one of which is the back plate 18 and the other of which is the workpiece surface 20. Thus, by insuring that the workpiece surface 20 and the housing 12 do not make contact or by providing for a gap between the conductive back plate 18 and the walls of the housing 12, the non-preferred modes are suppressed and the circular $TE_{0np}$ mode is selected.

Figure 2:
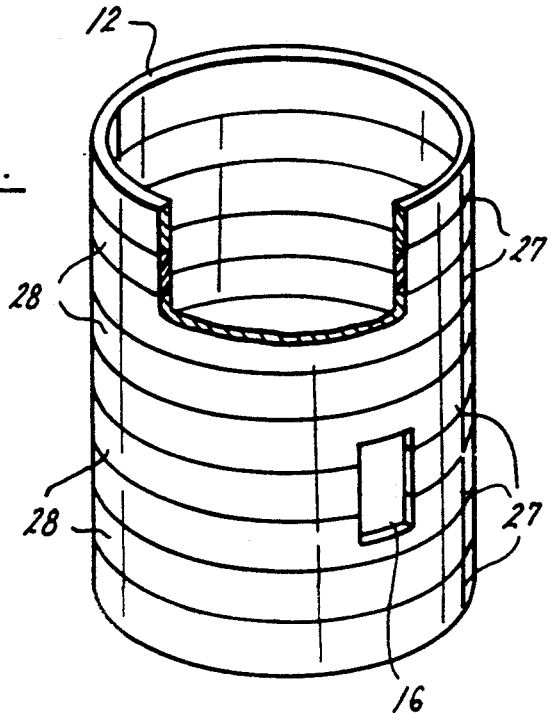
FIG. 2 is a perspective view of alternative embodiment of a microwave applicator cavity which has been segmented into alternating conductive and insulating rings.

An alternative method of suppressing competing modes is shown in FIG. 2 in which the cylindrical housing 12 is segmented into a plurality of rings. The rings are alternately composed of a conductive material 27 such as copper or aluminum and an electrically insulating material 28 such as teflon or polyethylene. As well known to those skilled in the art, alternate conductive and electrically insulating materials may be use as well. With the applicator cavity segmented as in FIG. 2, non-preferred modes are suppresed since the rings composed of a conductive material 27 support the circular currents required for the $TE_{0np}$ mode while the alternate insulating rings 28 suppress any longitudinal currents, and thus other competing modes of resonance that produce longitudinal currents. As shown in FIG. 1, the housing 12, shown in FIG. 2, may be connected to a waveguide, not illustrated, by means of an aperture 16.

In either embodiment, the conductive back plate 18 is connected to an adjustment means 26 for varying the position of the back plate 18 axially within the cylindrical housing 12. The adjustment means 26 may be piston actuated or other control means for moving the backplate 18 longitudinally within the cavity. As shown in FIG. 4, the adjustment means may comprise a threaded shaft 58 which is rigidly affixed to the backplate 18. The shaft 58 is threadably engaged by a positioning plate 52 which may be fastened to the housing 12 by a attachment means, such as the bolts 54 and nuts 56 shown in FIG. 4.

The position of the back plate 18 is adjusted in order to cause the cavity resonance frequency to be equal to that of the microwave generator 24. To support the $TE_{0np}$ mode, this adjustment is performed so that the distance, d, between the inner surface of the conductive back plate 18 and the workpiece surface to be heated 20 is calculated according to the following formula:

$$d=p(\lambda/2)[e_r-((X_n\lambda)/\{2\pi r\})^2]^{-\frac{1}{2}}$$

wherein p is a positive integer greater than zero, $\lambda$ is the free-space wavelength of microwave radiation to be supported by the cavity, r is the inside radius of the cylindrical housing 12, $\pi$ is the irrational number 3.141592669, $e_r$ is the relative dielectric constant of the material interior to the cavity, and $X_n$ is the $n^{th}$ zero of the first-order Bessel function $J_1(X_n)$. $J_1(X_n)$ is also defined as the negative derivative of the zero-order Bessel function $(-J_0'(X_n))$.

Bessel functions and their zeros are discussed on page 271 of Electron Spin Resonance by Charles P. Poole, Jr. The first seven zeros of $J_1(X_n)$, and correspondingly the negative derivative of the zero-order Bessel function $(-J_0'(X_n))$, are: $X_0=0$, $X_1=3.8317$, $X_2=7.0156$, $X_3=10.1735$, $X_4=13.3237$, $X_5=16.4706$, and $X_6=19.6159$. The value of n in $X_n$ is equivalent to the value of the subscript n in $TE_{0np}$. Thus, the value of n is dependent on the selection of the mode of resonance which the cavity is to support. For example, if it is desirable that the cavity support the $TE_{03p}$ mode of resonance, the value of $X_3$ or 10.1735 is substituted for $X_n$ in the aforementioned equation for d.

As an example, for a typical microwave frequency such as 2450 megahertz, having a corresponding wavelength of 12.23 centimeters, operating in a $TE_{01p}$ mode ($X_n=X_1=3.83217$) to be supported by an air-filled ($e_r=1.0$) cylindrical cavity with a radius of 3.5 inches (8.89 centimeters), the conductive back plate would need to be adjusted so as to be an integral multiple p of 4.43 inches (11.24 centimeters) from the workpiece surface to be heated.

In certain applications it may therefore be desirable to adjust the distance between the back plate 18 and the workpiece surface 20 in order to accommodate changes in the operating frequency. In other applications it may be best to vary the operating frequency to accommodate unavoidable changes in the cavity length, i.e. the distance between the back plate 18 and the workpiece surface 20, or variable loading conditions on the applicator 10.

An additional feature of the microwave applicator 10 is the capability of filling the applicator cavity 13 with a dielectric material other than air, such as quartz, alumina, or mica, so as to alter the size and shape of the region which will be heated to accommodate the requirements of the particular process. Various other dielectric materials, well known to those skilled in the art, may be utilized as well as the aforementioned dielectric materials. For an isotropic dielectric material, the applicator cavity's diameter and length required to support the identical frequency of microwave radiation will vary inversely as the square root of the dielectric constant of the material used to fill the cavity. For example with the applicator cavity filled with a material with a dielectric constant, $e_r$, of 9, such as alumina, the physical dimensions of the applicator cavity would decrease by a factor of 3. Thus, for an applicator cavity to support the same 2450 megahertz microwave frequency as in the preceding example, the nominal radius of the cavity would become 1.15 inches and the length would become approximately 1.5 inches so that the back plate would need to be adjusted to be an integral multiple p of the length, 1.5 inches, from the surface to be heated.

Alternatively, the applicator cavity may be either partially filled with a dielectric or completely or partially filled with an anisotropic dielectric in which cases the circular shape of the applicator cavity and the corresponding heating pattern may be changed to some other shape, such as an ellipse, as is well known to those skilled in the art. The anisotropic dielectric may even be an artificial dielectric, such as an array of conducting metal objects embedded in another dielectric material. Gaseous dielectrics in addition to air may be used, such as sulphur hexaflouride or steam. While the use of gaseous dielectrics would not alter the size of the cavity, their use would increase the allowable field strength by suppressing ionic disassociation within the cavity.

Referring to FIG. 3, there is shown the magnetic field 30, electric field 32 and current 34 relationships established by the applicator in the $TE_{011}$ mode resonance. The circular pattern of the surface currents 34*a*, which heat the workpiece, are a result of the utilization of the $TE_{011}$ mode. The characteristic which makes the $TE_{0np}$ modes desirable is illustrated FIG. 3 in that the current is limited to the cylindrical walls of the housing 12, the backplate 18, or the workpiece surface 20, but in any instance there is essentially no current running between the backplate 18 and the walls of the housing 12 nor between the walls of the housing 12 and the workpiece surface 20. Thus, with reference now to FIG. 1, there is no need to establish contact between the applicator 10 and either the back plate 18 or the workpiece surface 20 in order to have current present in the workpiece surface to be heated 20. Therefore, unwanted finish marks are virtually eliminated. Furthermore, since current is not conducted from the housing 12 to the workpiece surface 20, arcing does not occur and the energy transfer is therefore efficient and substantially constant.

Nevertheless, in some instances in which a dielectric is used to fill, either partially or completely, the applicator cavity, the surface of the dielectric filling the applicator cavity 13 may be configured to touch the surface to be heated 20. This configuration of the dielectric may cause significant contact pressure between the surface to be heated 20 and the dielectric material. The additional contact pressure will cause the material being added, such as a thin layer of conductive-fiber tape 40 in FIG. 4, to be compressed into contact with the material 44 with which it is being bonded. However, this is accomplished without electrical contact between the parts, thus avoiding arching.

In numerous applications it is desirable to induce a current into a material without maintaining electrical contact with the material. An exemplary application is shown in FIG. 4 in which conductive-fiber composite materials are formed by heating a thin layer of conductive-fiber tape 40, such as carbon-PEEK tape, with the microwave applicator 10 which receives the microwave energy from a standard microwave generator 24 via waveguide 14. While being compacted by the rollers 48, the heated tape 40 is bonded to the part being formed 44 which in turn is supported by tooling 50. The axially mounted rollers 48 may be spring-actuated to absorb uneven loading conditions. While simple rollers are illustrated in FIG. 4 for use with forming substantially flat or some types of cylindrical parts, a compliant compaction roller or device may be required on parts with compound curvature.

For a conductive fiber tape with thermoplastic resin, the unconsolidated tape 41 and the surface of the part 44 are heated to point where they readily melt and fuse together. In addition to the resistive heating, thermal diffusion, the relative motion of the tape with respect to the applicator 10, and the compaction forces exerted by the rollers 48 urge the tape 41 and the part 44 to fuse together and eliminate temperature gradients formed by the resistive heating patterns so as to result in a uniformly consolidated structure with a homogeneous structure.

Alternatively, a conductive fiber tape with thermoset resin may also be used in which case the consolidation occurs due to polymer crosslinking between the tape 41 and the part 44 instead of the melting and recrystallization occurring in a conductive fiber tape with thermoplastic resin. The resistive heating is still required with thermoset resin tapes as the polymer crosslinking also occurs at an elevated temperature.

The resistive heating induced by the $TE_{0np}$ mode of resonance occurs in a region near the surface known either as the "skin depth" or the penetration depth. This depth, $\delta$, is determined by the electrical conductivity, $\sigma$, of the surface material and the frequency, f, of the microwave radiation to which it is exposed and is calculated by the following formula:

$$\delta=(\pi\mu f\sigma)^{-\frac{1}{2}}$$

wherein $\pi$ is the irrational number 3.141592669 . . . and $\mu$ is the magnetic permeability of the material. The magnetic permeability is usually nearly equal to that of free space which is approximately $1.257\times10^{-6}$ volt-second/amp-meter. Thus, the penetration depth of microwave energy with a 2450 megahertz frequency in a consolidated carbon-fiber composite material which typically have a surface conductivity of about 20,000 Siemens/meter is approximately 0.003 inches. The frequency, with the surface conductivity of the composite material in mind, must be chosen so that the penetration depth $\delta$ does not exceed the thickness of the tape being consolidated to minimize unnecessary heating and melting of the consolidated layers.

It is desirable in current conductive-fiber composite forming processes to apply at least 100 feet of conductive-fiber tape to the pre-formed substrate every minute. In order to provide adequate heating to bond the tape to the substrate, it is necessary that the surface currents induced in the tape and substrate be approximately 45 amps per centimeter. If an applicator were used in this situation which required contact between the applicator and the heated surface, its design and operation would be very burdensome since for currents of such large magnitude, 45 amps per centimeter in this example, the contacts carrying the currents between the applicator and the substrate would need to have very low resistance, such as one-tenth of the conductivity of the conductive-fiber tape, so as to not substantially dissipate the energy within the contact region instead of within the substrate itself. Additionally, the potential for damaging arcing to occur if an inadvertent gap occurred in such prior art applicator systems is enlarged by the requirement of operating at such large currents. Thus, the usefulness of the microwave applicator 10 utilizing the $TE_{0np}$ modes which require no contact between the applicator and the surface to be heated is well demonstrated in this example application since the relatively large currents may be directly induced into the substrate and tape so that no energy loss occurs in the region between the applicator and the substrate. Also, the possibility of damaging arcing occurring is eliminated by use of the $TE_{0np}$ modes of resonance.

Although there has been illustrated and described specific detail and structure of operations, it is clearly understood that the same were merely for purposes of illustration and that changes and modifications may be readily made therein by those skilled in the art without departing from the spirit and the scope of this invention.

We claim:

1. A microwave heating device for inducing currents in an electrically conductive surface to be heated, comprising:

a) a microwave energy source means for generating microwave energy;

b) a waveguide means coupled to the microwave energy source means for transmitting the microwave energy from the microwave energy source means;

c) a cylindrical housing means coupled to the waveguide means for resonating predetermined modes of microwave energy:

d) the cylindrical housing means having an adjustable end mounted to provide axial movement within the cylindrical housing means to change the length thereof; and e) the cylindrical housing means having an open end for resonating microwave energy within a cavity formed by the cylindrical housing means and an electrically conductive surface in close proximity to the open end of the cylindrical housing means for coupling microwave energy to the electrically conductive surface.

2. The microwave applicator as recited in claim 1, wherein the housing means is comprised of a conductive material.

3. The microwave applicator as recited in claim 2, wherein the mode of microwave energy resonated within the cylindrical housing means is selected from the $TE_{0np}$ modes, wherein n and p are positive integers greater than zero.

4. The microwave applicator as recited in claim 3, wherein the mode of microwave energy selected is $TE_{011}$ mode.

5. The microwave applicator as recited in claim 3, wherein the mode of microwave energy selected from the group consisting of the $TE_{012}$ mode and the $TE_{021}$ mode.

6. The microwave applicator as recited in claim 3, further comprising a dielectric material within the housing.

7. The microwave applicator as recited in claim 6 wherein said dielectric material is isotropic.

8. The microwave applicator as recited in claim 6 wherein said dielectric material is anisotropic.

9. The microwave applicator as recited in claim 1, wherein the cylindrical housing means is segmented into a plurality of adjacent rings composed alternately of conductive material and insulating material.

10. The microwave applicator as recited in claim 9, wherein the mode of microwave energy resonated within the cylindrical housing means is selected from the $TE_{0np}$ modes, wherein n and p are positive integers greater than zero.

11. The microwave applicator as recited in claim 10, wherein the mode of microwave energy selected is $TE_{011}$ mode.

12. The microwave applicator as recited in claim 10, wherein the mode of microwave energy selected from the group consisting of the $TE_{012}$ mode and the $TE_{021}$ mode.

13. The microwave applicator as recited in claim 10, further comprising a dielectric material within the housing.

14. The microwave applicator as recited in claim 13 wherein said dielectric material is isotropic.

15. The microwave applicator as recited in claim 13 wherein said dielectric material is anisotropic.

* * * * *